US009052657B2

(12) United States Patent
Watanabe

(10) Patent No.: US 9,052,657 B2
(45) Date of Patent: Jun. 9, 2015

(54) IMAGE HEATING APPARATUS

(75) Inventor: Tatsuhito Watanabe, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 398 days.

(21) Appl. No.: 13/353,500

(22) Filed: Jan. 19, 2012

(65) Prior Publication Data

US 2012/0201558 A1 Aug. 9, 2012

(30) Foreign Application Priority Data

Feb. 3, 2011 (JP) ..... 2011-022123

(51) Int. Cl.
*G03G 15/20* (2006.01)

(52) U.S. Cl.
CPC .... *G03G 15/2078* (2013.01); *G03G 2215/2035* (2013.01)

(58) Field of Classification Search
USPC ..... 399/122, 328–330
See application file for complete search history.

(56) References Cited

U.S. PATENT DOCUMENTS 7,136,601 B2 11/2006 Akizuki et al.
8,824,925 B2 * 9/2014 Sugaya et al. ..... 399/122
2004/0033084 A1 2/2004 Akizuki et al.
2010/0215390 A1 * 8/2010 Tomita et al. ..... 399/69
2012/0248097 A1 * 10/2012 Takeuchi et al. ..... 219/635

FOREIGN PATENT DOCUMENTS

CN 1470956 A 1/2004
JP 10-171276 A 6/1998
JP 2004-151442 A 5/2004

OTHER PUBLICATIONS

Chinese Office Action dated Mar. 5, 2014, issued in counterpart Chinese Application No. 201210023609.1, and English-language translation thereof.

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image heating apparatus includes a belt member for heating an image on a recording material; a heater heating the belt member; a supporting portion, provided on an inner surface of the belt member, for detachably supporting the belt member; a temperature detecting member contacted to the inner surface of the belt member and elastically supported by the supporting portion; a controller for controlling energization to the heater on the basis of an output of the temperature detecting member; and an inclined surface, provided to the temperature detecting member, for guiding the temperature detecting member toward an inside of the belt member in contact with the belt member during a mounting operation of the belt member to the supporting portion.

10 Claims, 13 Drawing Sheets

(a)

(b)

IMAGE HEATING APPARATUS

FIELD OF THE INVENTION AND RELATED ART

The present invention relates to an image heating apparatus for heating a recording material, on which a toner image is carried, in a heating nip between a heating belt member and a rotatable pressing member. Specifically, the present invention relates to a structure of a temperature detecting portion for detecting a temperature of the heating belt member.

An image forming apparatus in which the recording material on which the toner image is transferred is heated and pressed by the image heating apparatus to fix the toner image on the recording material has been widely used. The image heating apparatus, as a discrete apparatus, for heating and pressing the recording material on which a partly or completely fixed toner image is carried, thus imparting a desired surface property to an image has also been put into practical use.

As the image heating apparatus, in recent years, the image heating apparatus of a heating belt type in which the recording material, on which the toner image is carried, is heated in the heating nip between the locally heated heating belt member and the rotatable pressing member has been put into practical use (Japanese Laid-Open Patent Application (JP-A) 2004-151442). In the image heating apparatus of the heating belt type, the weight of a portion to be heated is low and therefore the time until the temperature of the image heating apparatus after actuation reaches a temperature capable of permitting the heat fixing is only required to be short, so that the image heating apparatus is advantageous for image formation of a so-called on-demand type.

In such an image heating apparatus, a mounting step of the heating belt member is required at a manufacturing floor, an installation location or the like. As an example thereof, JP-A Hei 10-171276 discloses an assembling structure of the image heating apparatus configured so that only the heating belt member is removed from the image heating apparatus at the floor or location and then can be replaced with a new heating belt member.

In the image heating apparatus of JP-A 2004-151442, the temperature of a supporting structure for pressing and supporting the heating belt member from the inside of the heating belt member is detected and then a heater for the heating belt member is controlled, and therefore the accuracy of temperature control in the heating nip is lowered. In the image heating apparatus of the heating belt type, the weight of the portion to be heated is light and therefore even when the temperature of the supporting structure is detected in a region in which the heating belt member is contacted to the recording material, the variation between the heating temperature of the recording material and the detected temperature becomes large. When heating of the heating belt member is controlled on the basis of the detected temperature providing the large variation, a variation of glossiness occurs on a fixed image.

Therefore, detection of the temperature of the heating belt member by bringing a temperature detecting portion into contact with an inner surface of the heating belt member at a downstream side of the heating nip with respect to a rotational direction of the heating belt member was proposed. This is because it is possible to detect the temperature very close to the heating temperature of the recording material by detecting the temperature of the heating belt member immediately after the heating belt member contacts and heats the recording material.

However, in this case, the temperature detecting portion has a structure in which it is elastically urged to contact the inner surface of the heating belt member, so that when the heating belt member is removed (pulled out), the temperature detecting portion is projected toward the outside. For this reason, when the heating belt member is replaced with a new one, the temperature detecting portion interferes with an edge of the new heating belt member to be inserted (FIG. 6). When the temperature detecting portion interferes with the edge of the new heating belt member to be inserted and thus the attitude of the new heating belt member is changed, contact between the temperature detecting portion and the inner surface of the heating belt member becomes unstable to increase the variation of the detected temperature, so that uneven glossiness occurs on the fixed image.

SUMMARY OF THE INVENTION

A principal object of the present invention is to provide an image heating apparatus capable of improving a degree of stabilization of a contact state between a temperature detecting portion and an inner surface of a heating belt member even when replacement of the heating belt member with a new heating belt member is repeated.

According to an aspect of the present invention is to provide an image heating apparatus comprising: a belt member for heating an image on a recording material; heating means for heating the belt member; a supporting portion, provided on an inner surface of the belt member, for detachably supporting the belt member; a temperature detecting member contacted to the inner surface of the belt member and elastically supported by the supporting portion; a controller for controlling energization to the heating means on the basis of an output of the temperature detecting member; and an inclined surface, provided to the temperature detecting member, for guiding the temperature detecting member toward an inside of the belt member in contact with the belt member during a mounting operation of the belt member to the supporting portion.

These and other objects, features and advantages of the present invention will become more apparent upon a consideration of the following description of the preferred embodiments of the present invention taken in conjunction with the accompanying drawings.

Figure 4:
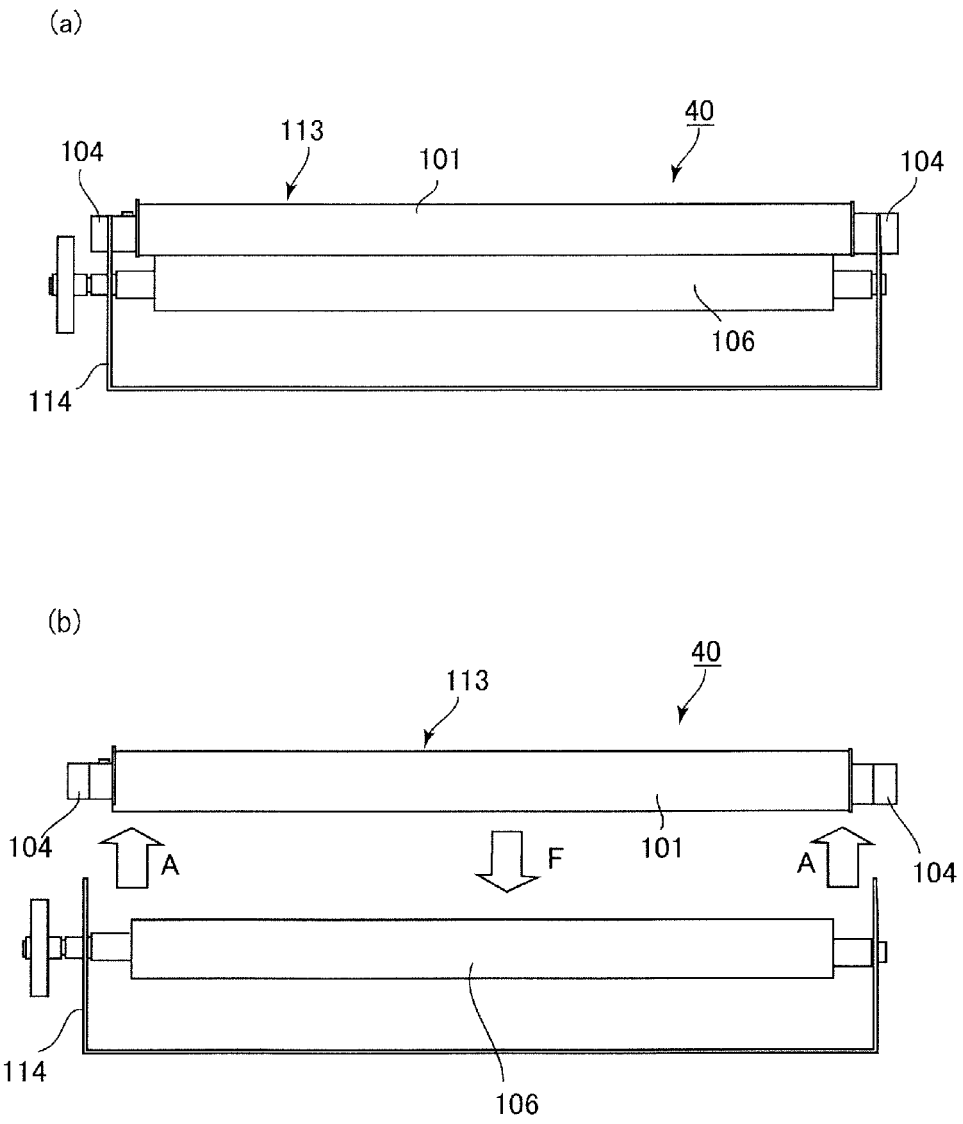

Parts (a) and (b) of FIG. 4 are illustrations of a front half portion of a fixing belt exchanging (replacing) operation.

Figure 5:
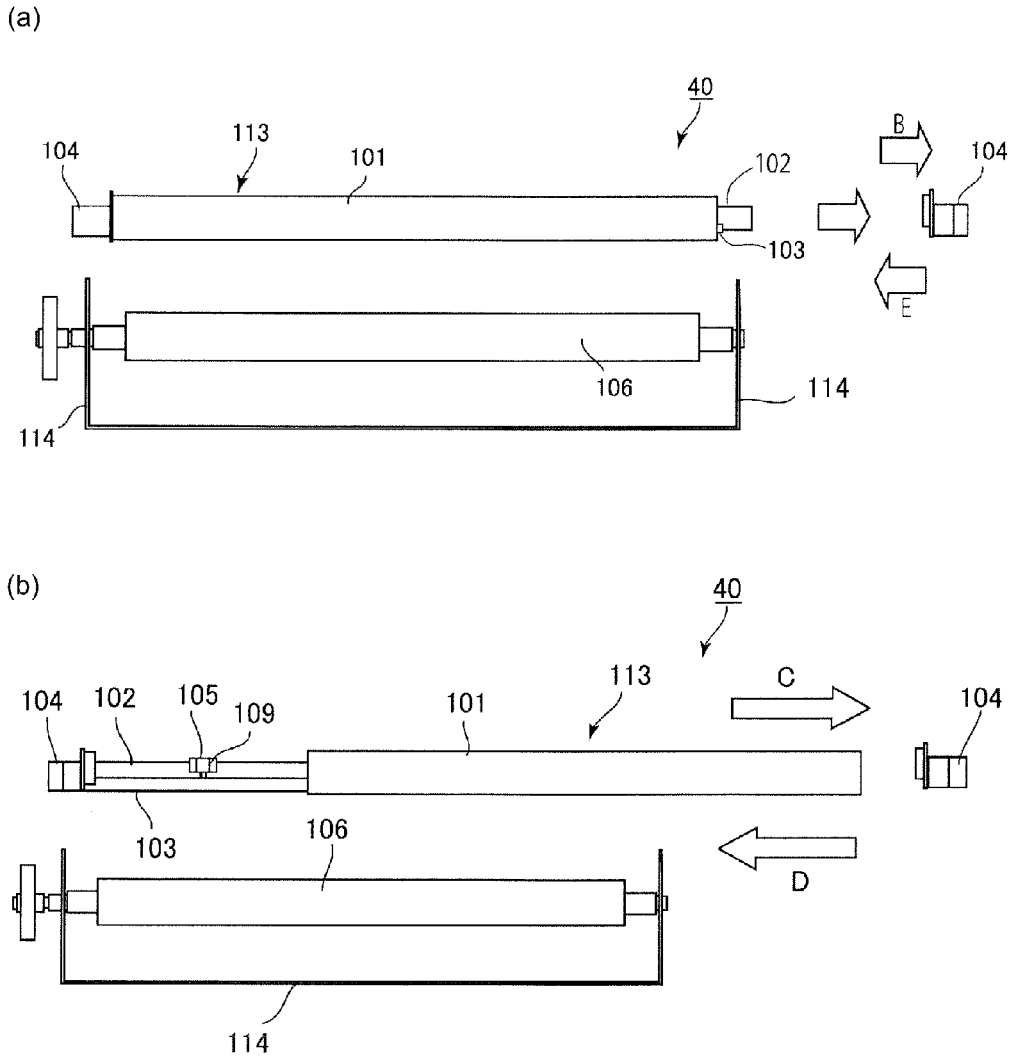

Parts (a) and (b) of FIG. 5 are illustrations of a latter half portion of the fixing belt exchanging operation.

Figure 6:
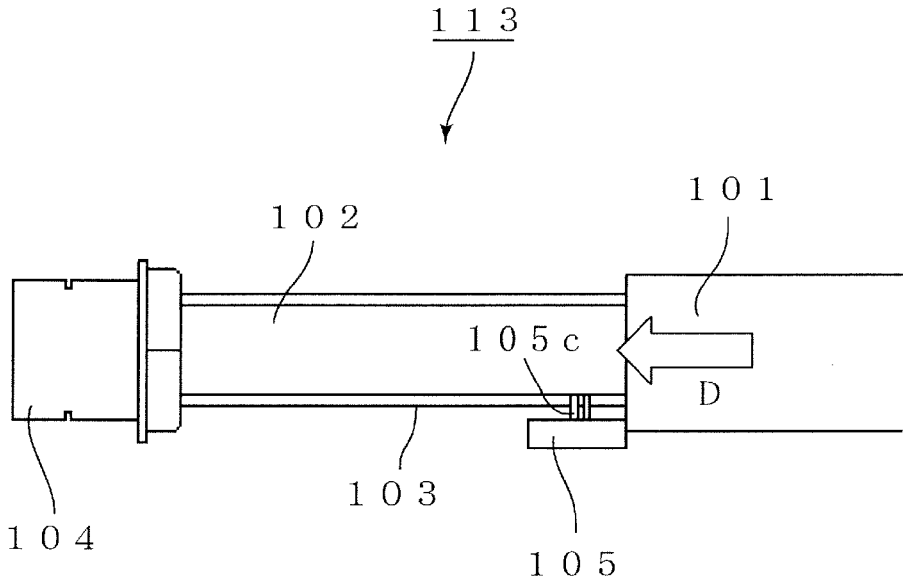

FIG. 6 is an illustration of a structure of a fixing device in Comparative Embodiment.

Figure 7:
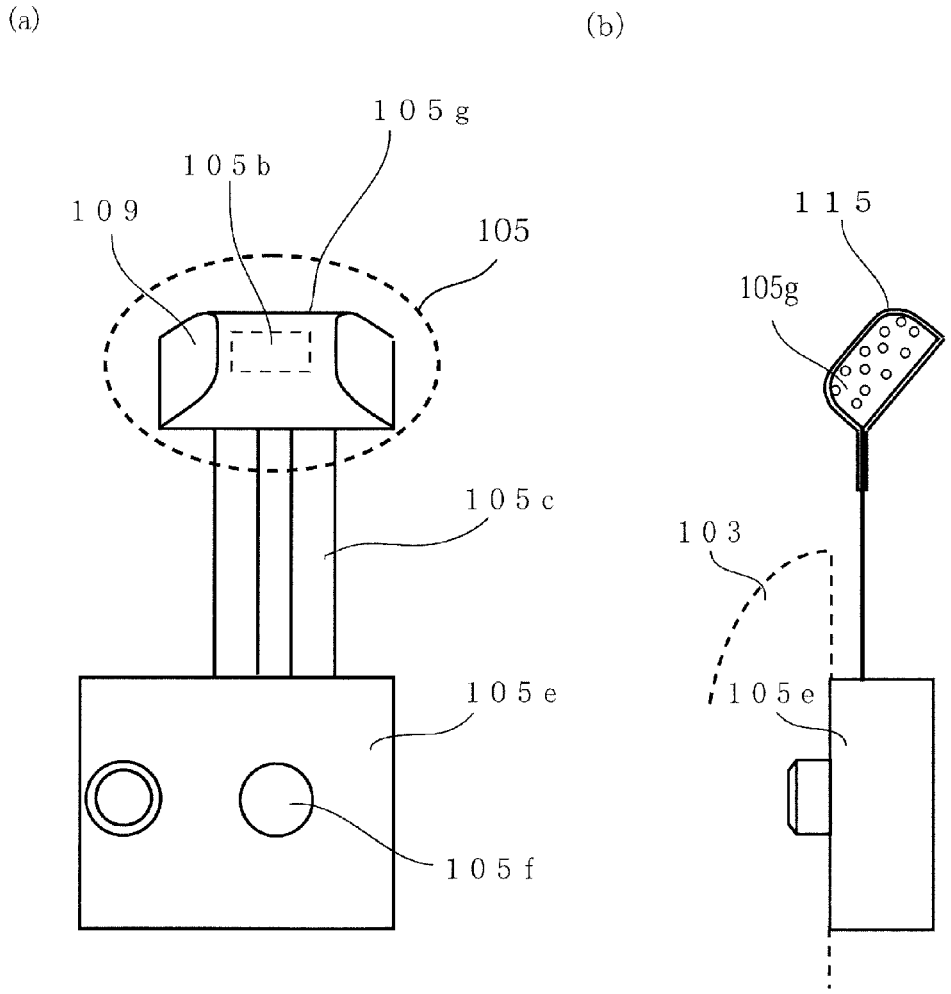

Parts (a) and (b) of FIG. 7 are illustrations of a structure of a temperature detecting portion in a fixing device in Embodiment 1.

Figure 8:
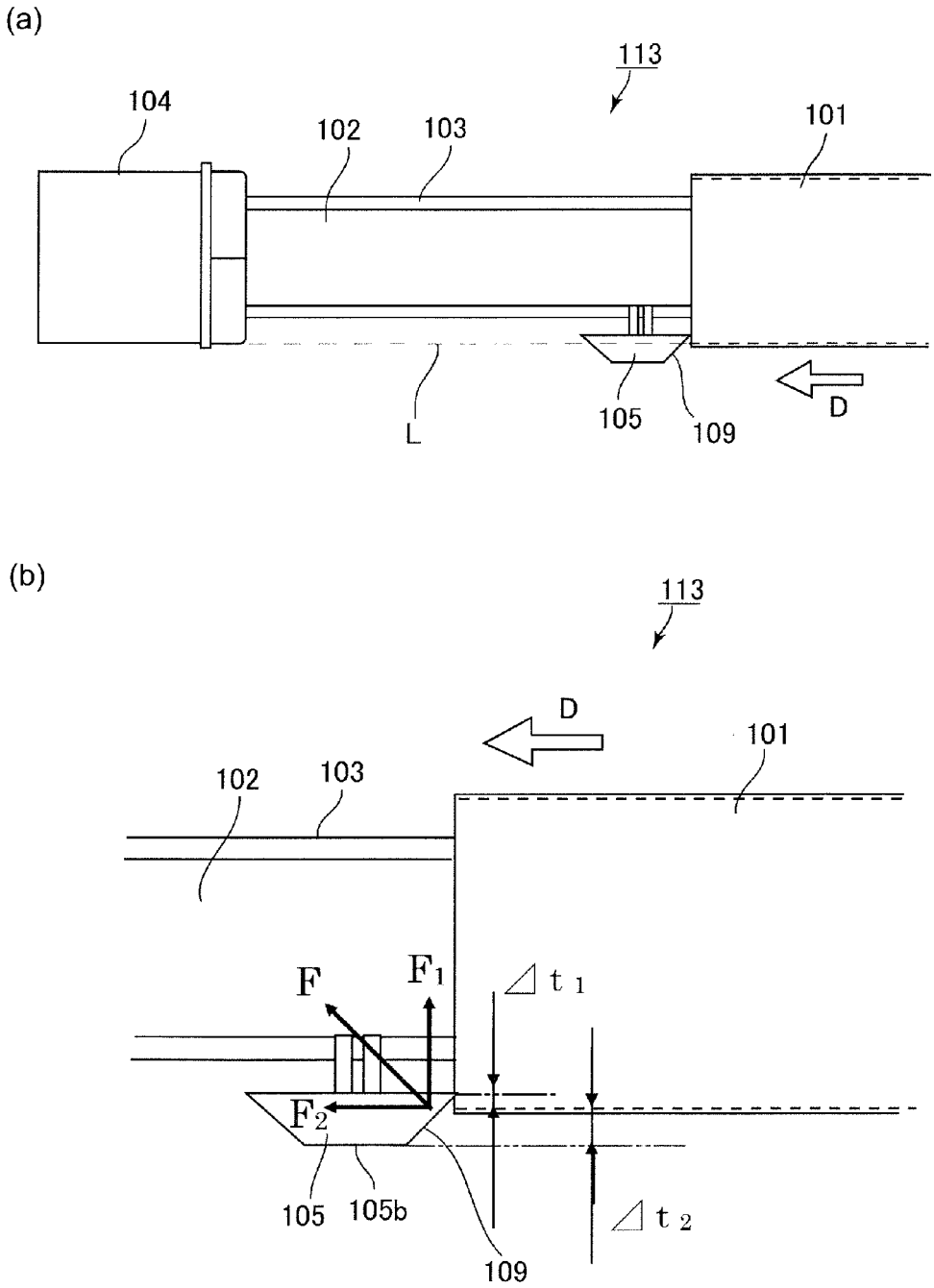

Parts (a) and (b) of FIG. 8 are illustrations of a balance of forces exerted on the temperature detecting portion.

Figure 9:
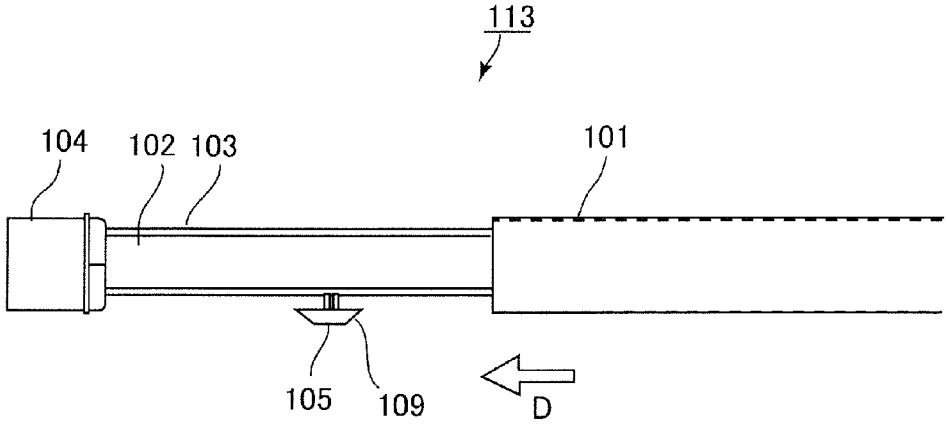
Figure 9:
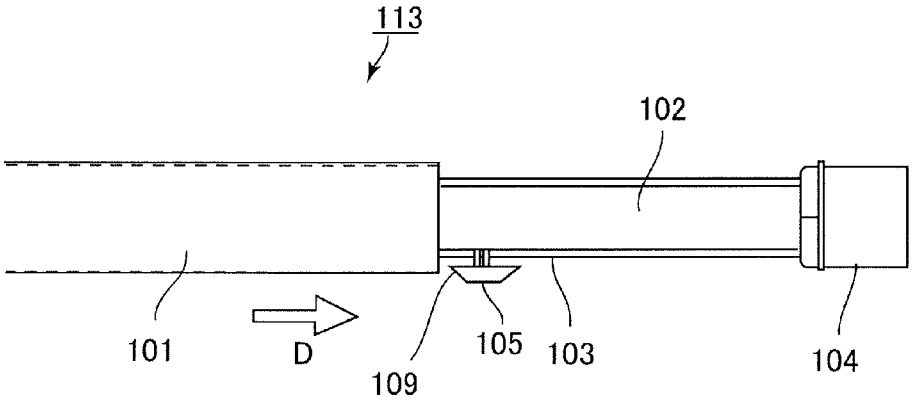

Parts (a) and (b) of FIG. 9 are illustrations of interference between an edge of the fixing belt and the temperature detecting portion.

Figure 10:
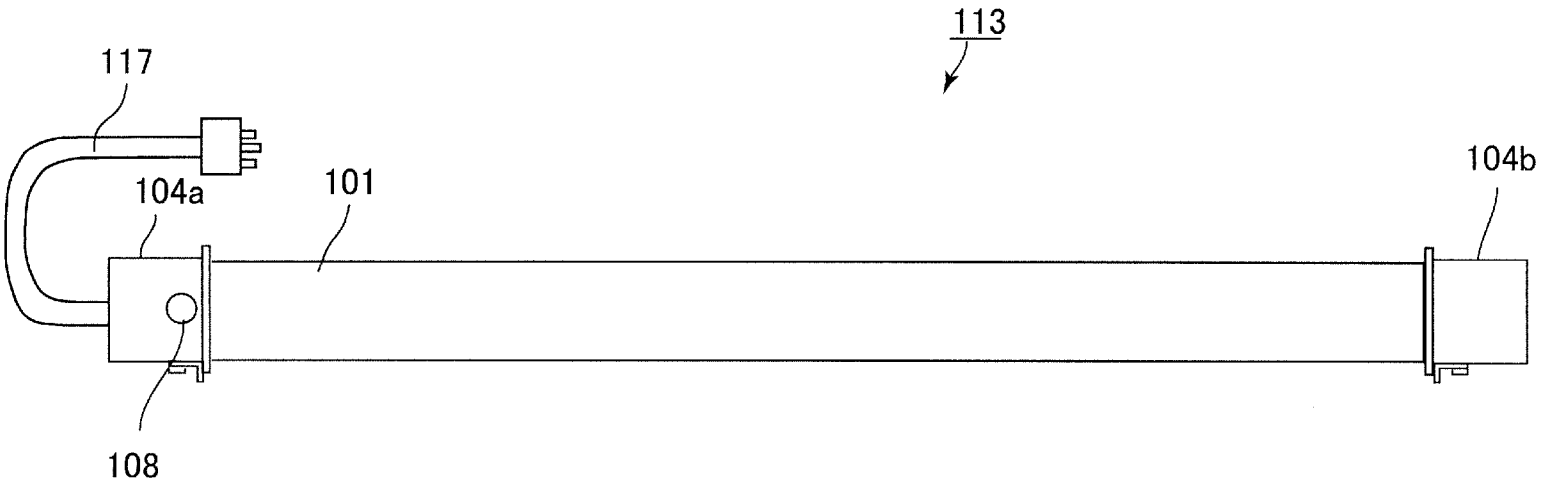

FIG. 10 is an illustration of a structure of a fixing device in Embodiment 2.

Figure 11:
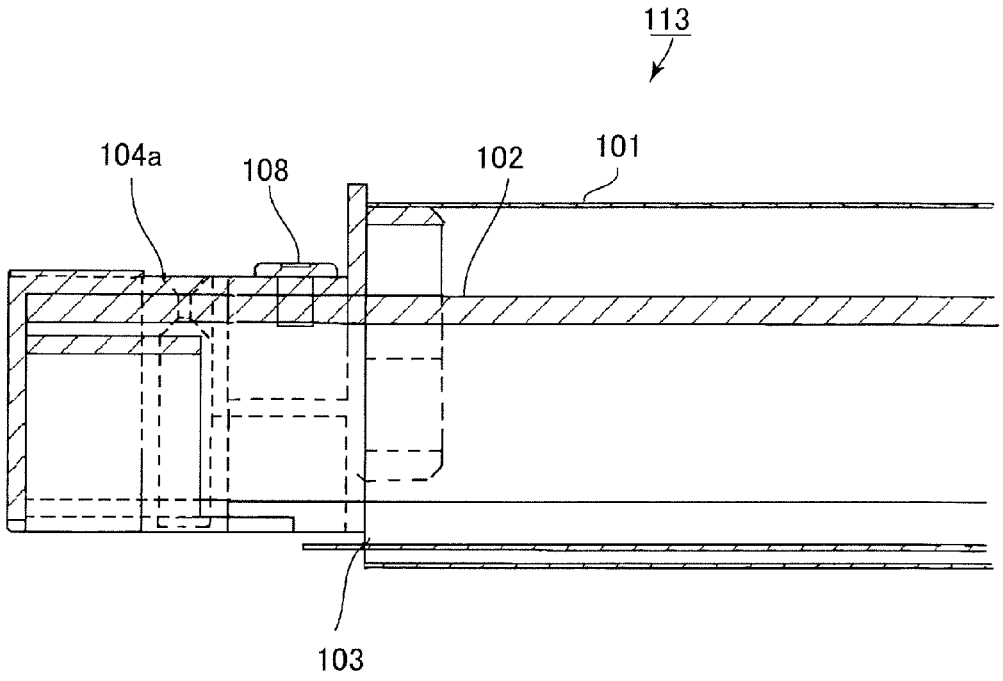

FIG. 11 is an illustration of a fixing flange-mounted structure.

Figure 12:
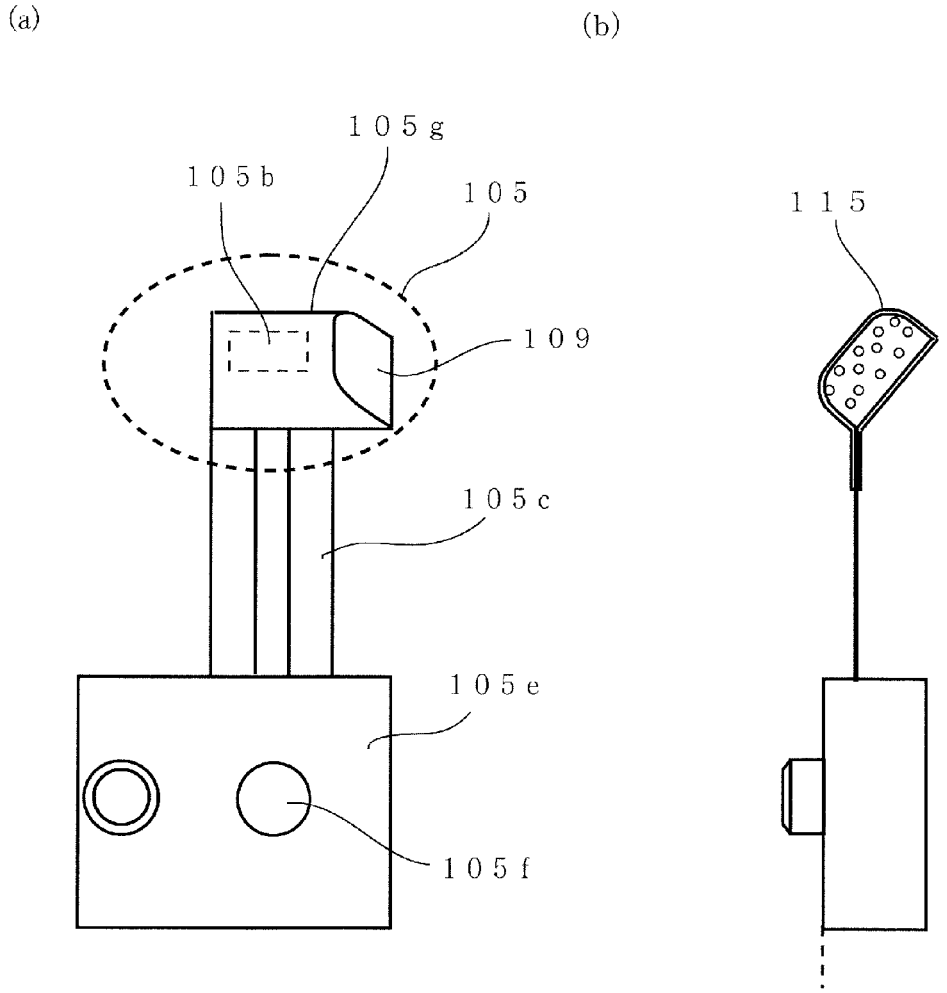

Parts (a) and (b) of FIG. 12 are illustrations of a structure of a temperature detecting portion in a fixing device in Embodiment 2.

Figure 13:
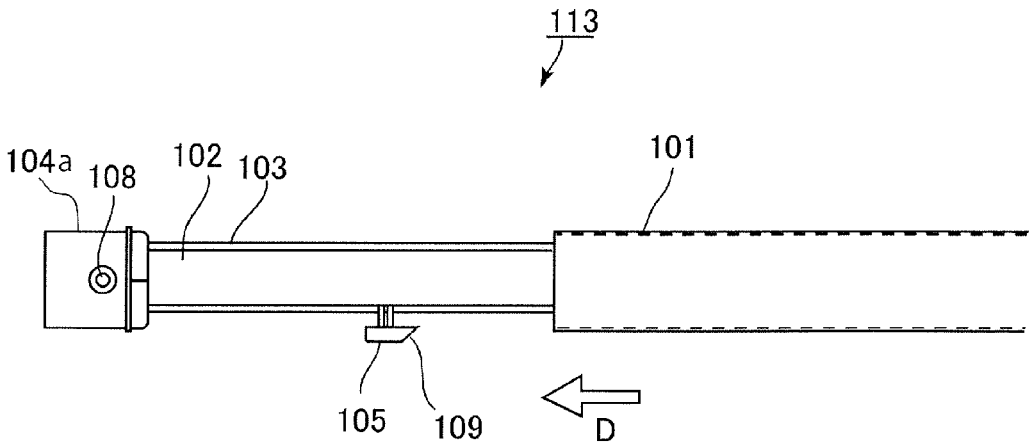

FIG. 13 is an illustration of interference between an edge of the fixing belt and the temperature detecting portion.

DESCRIPTION OF THE PREFERRED EMBODIMENTS

Hereinbelow, embodiments of the present invention will be described in detail with reference to the drawings. The present invention can be carried out also in other embodiments in which a part or all of constitutions of the respective embodiments are replaced by their alternative constitutions so long as a temperature detecting portion is elastically urged against and contacted to an inner surface of a fixing belt.

Therefore, the present invention can be carried out irrespective of the types of monochromatic/full-color, sheet-feeding/recording material conveyance/intermediary transfer, a toner image forming method and a transfer method if in an image forming apparatus, a toner image is fixed on a recording material, on which the toner image is transferred, is heated and pressed. An image heating apparatus includes, in addition to a fixing device, a surface heating apparatus (device) for adjusting glossiness or surface property of an image.

In the following embodiments, only a principal portion concerning formation/transfer of the toner image will be described but the present invention can be carried out in image forming apparatuses with various uses including printers, various printing machines, copying machines, facsimile machines, multi-function machines, and so on by adding necessary equipment, options, or casing structures.

<Image Forming Apparatus>

Figure 1:
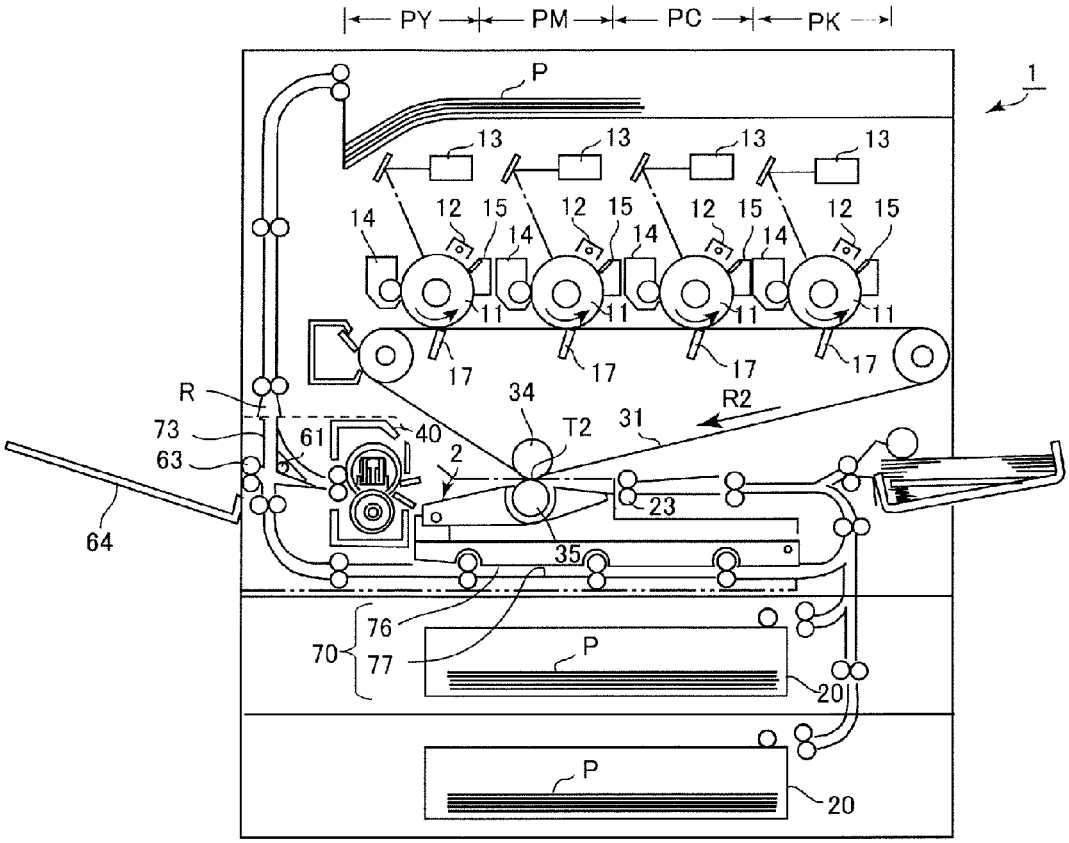
FIG. 1 is an illustration of a structure of an image forming apparatus.

FIG. 1 is an illustration of structure of an image forming apparatus.

As shown in FIG. 1, an image forming apparatus 1 in this embodiment is a tandem-type full-color printer of an intermediary transfer type in which image forming portions PY, PM, PC and PK for yellow, magenta, cyan and black, respectively, are arranged along an intermediary transfer belt 31.

In the image forming portion PY, a yellow toner image is formed on a photosensitive drum 11(Y) and then is primary-transferred onto the intermediary transfer belt 31. In the image forming portion PM, a magenta toner image is formed on a photosensitive drum 11(M) and is primary-transferred superposedly onto the yellow toner image on the intermediary transfer belt 31. In the image forming portions PC and PK, a cyan toner image and a black toner image are formed on photosensitive drums 11(C) and 11(K), respectively, and are successively primary-transferred superposedly onto the intermediary transfer belt 31.

Recording material P is pulled out from a recording material cassette 20 one piece at a time and awaits further processing between registration rollers 23.

The recording material P is sent by the registration rollers 23 toward a secondary transfer portion T2 while being timed to the toner images on the intermediary transfer belt 31, and the toner images are secondary-transferred from the intermediary transfer belt 31 onto the recording material P. The recording material P on which the four color toner images are secondary-transferred is conveyed into a fixing device 40, and after being heated and pressed by the fixing device 40 to fix the toner images thereon, is discharged onto an external tray 64 by discharging rollers 63.

On the other hand, in the case where the toner images are formed on both surfaces of the recording material P, the recording material P on which the toner images are fixed on one surface thereof by the fixing device 40 is guided upward by a flapper 61. The recording material P is turned upside down by being switchback-conveyed along a conveyance path 73 and thereafter is conveyed on a both-side (recording material) conveyance path 70 to wait between the registration rollers 23. Then, the toner images are formed also on the other surface of the recording material P at the secondary transfer portion T2 and are, after being fixed by the fixing device 40, discharged onto the external tray 64.

The image forming portions PY, PM, PC and PK have the substantially same constitution except that the colors of toners of yellow, cyan, magenta and black used in developing devices 14(Y), 14(M), 14(C) and 14(K) are different from each other. In the following description, the yellow image forming portion PY will be described and other image forming portions PM, PC and PK will be omitted from redundant description.

The image forming station Pa includes the photosensitive drum 11 around which a charging roller 12, an exposure device 13, the developing device 14, a transfer blade 17, and a drum cleaning device 15 are disposed.

The charging roller 12 electrically charges the surface of the photosensitive drum 11 to a uniform potential. The exposure device 13 writes (forms) an electrostatic image for an image on the photosensitive drum 11 by scanning with a laser beam. The developing device 14 develops the electrostatic image to form the toner image on the photosensitive drum 11.

The transfer roller blade 17 is supplied with a voltage, so that the toner image on the photosensitive drum 11 is primary-transferred onto the intermediary transfer belt 31.

As the image heating apparatus, the fixing device of a heating roller type has been conventionally used widely but in recent years the fixing device of a belt heating type is widely used from the viewpoints of quick start and energy saving. The fixing device 40 of the belt heating type is suitable when it is used as the fixing device for image forming apparatuses using an electrophotographic process, an electrostatic recording process, a magnetic recording process, and the like. The image forming apparatus 1 forms an unfixed image (toner image), by using a transfer type or a direct type, on the recording material such as a transfer sheet, an electrofax sheet, electrostatic recording paper, an OHP sheet, a printing paper or a formatted paper. The fixing device 40 heat-fixes the unfixed image on the recording material surface as a permanently fixed image.

<Fixing Device>

Figure 2:
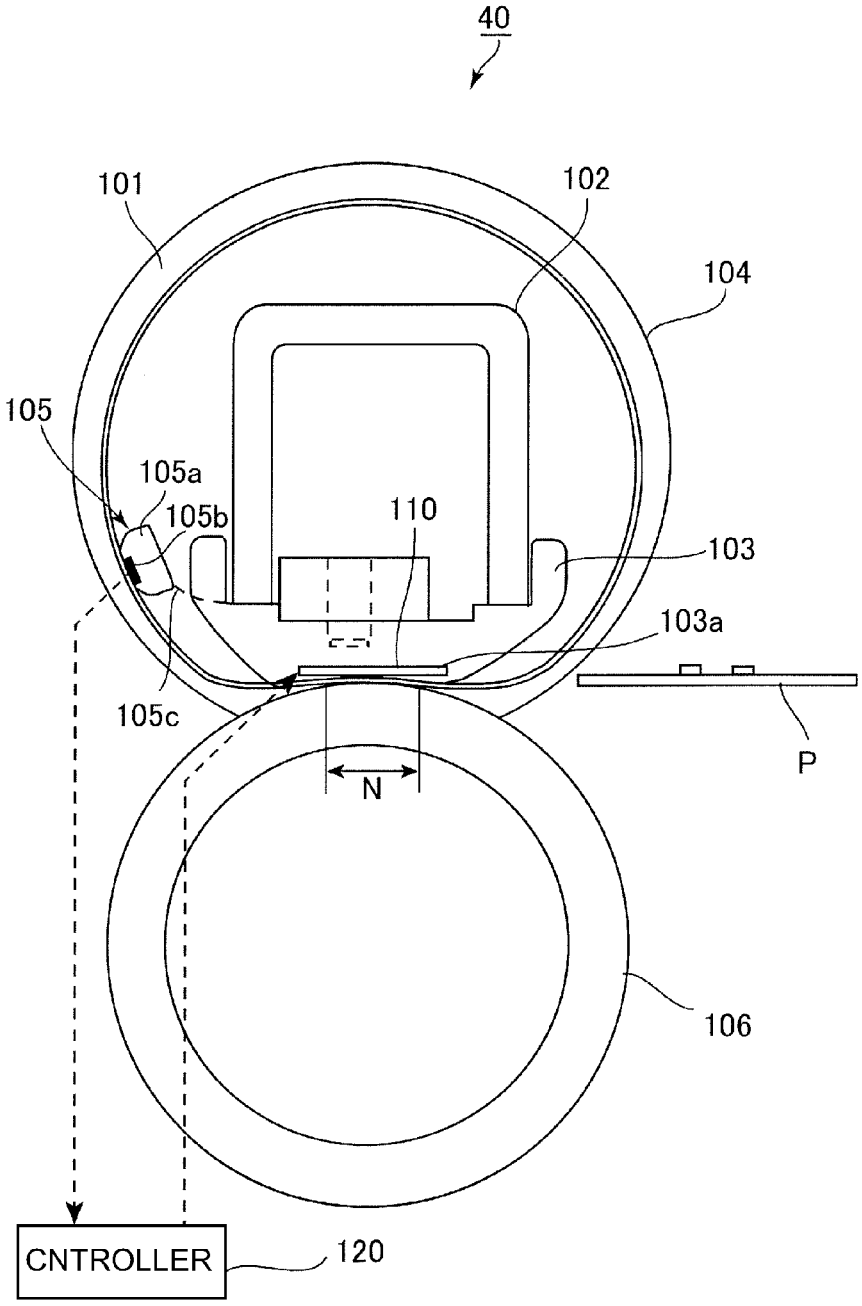
FIG. 2 is an illustration of a cross-sectional structure, of a fixing device, perpendicular to a longitudinal direction of the fixing device.
Figure 3:
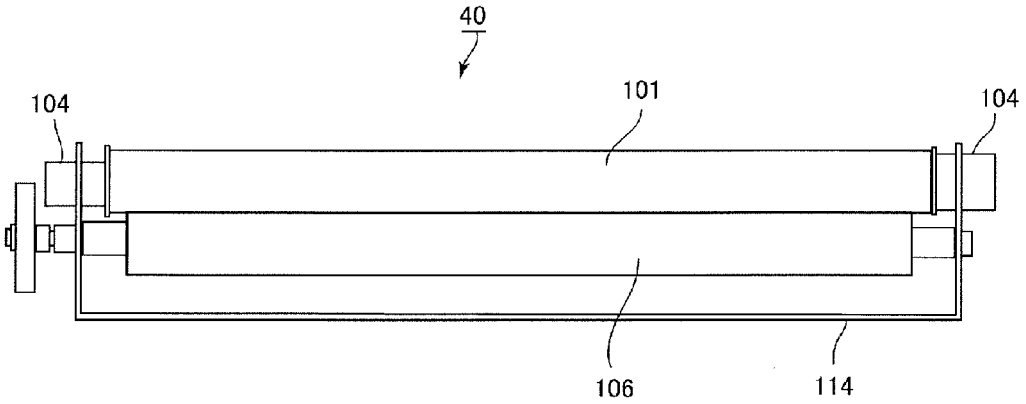
FIG. 3 is an illustration of a structure of the fixing device as seen from an exit side of the fixing device.

FIG. 2 is an illustration of a cross-sectional structure, of the fixing device, perpendicular to a longitudinal direction of the fixing device. FIG. 3 is an illustration of a structure of the fixing device as seen from an exit side of the fixing device. As shown in FIG. 2, the fixing device 40 is of a belt heating type using a fixing belt 101 and is of a pressing roller driving type.

The fixing device 40 forms a heating nip N by interposing the fixing belt 101 as a heat transferring portion between a ceramic heater 110 and a pressing roller 106. The fixing device 40 forms the heating nip N between the pressing roller 106 and the fixing belt 101 which is supported at its inner surface by a press-contact member 103 to which the ceramic heater 110 is fixed. Between the fixing belt 101 and the pressing roller 106, the recording material P on which the unfixed toner images are carried is guided, so that the unfixed toner images are superposed on the fixing belt 101 and are collectively nip-conveyed in the fixing (heating) nip N. As a result, the unfixed toner images are fixed on the recording material surface by pressure in the heating nip N while applying heat of the ceramic heater 110 via the fixing belt 101.

The fixing belt 101 is heat-resistant belt material formed in a cylindrical shape as a heating generating member for transferring the heat to the recording material P and is prepared by forming an elastic layer of a resin material on a cylindrical thin base layer of metal. The fixing belt 101 is externally engaged loosely on the press-contact member 103 which is disposed non-rotatably.

The fixing belt 101 is, in order to improve a quick start property by decreasing thermal capacity, 100 μm or less, respectively 50 μm or less and 20 μm or more, in belt thickness and may preferably be formed of the heat-resistant material. As the fixing belt 101, a belt having a single layer of PTFE, PFA or FEP or a belt having a composite layer formed by coating PTFE, PFA, FEP or the like on an outer peripheral surface of a layer of polyimide, polyamideimide, PEEK, PES, PPS, or the like can be used. The fixing belt 101 can be formed of also a metal belt material.

The press-contact member 103 is a heat-resistant and heat-insulating member which has a longitudinal direction crossing a conveyance direction of the recording material P and has a cross-sectional surface in a substantially arcuate shape. The press-contact member 103 performs the function of backing up the fixing belt 101 contacted to the pressing roller 106 to improve conveyance stability during the rotation of the fixing belt 101. The press-contact member 103 applies pressure to the heating nip N formed by press-contact between the pressing roller 106 and the fixing belt 101.

The press-contact member 103 is formed of a material, having good insulating and heat-resistant properties, such as phenolic resin, polyimide resin, polyamide resin, polyamide-imide resin, PEEK resin, PES resin, PPS resin, PFA resin, PTFE resin or LCP resin.

A stay 102 is a steel-made beam member which extends, inside the fixing belt 101, in the longitudinal direction of the fixing belt 101. The stay 102 is provided at an inner surface side of the fixing belt 101 in order to ensure the strength of the press-contact member 103. The stay 102 continuously supports a back surface of the press-contact member 103 formed of a relatively soft resin material to provide the press-contact member 103 with a bending strength with respect to the longitudinal direction and to linearly correct the lower surface of the press-contact member with respect to the longitudinal direction.

The ceramic heater 110 is used as a heating means. The ceramic heater 110 has, as described in JP-A 2004, 151442, a basic constitution including an elongated thin plate-like ceramic substrate and an energization heat generating resistor provided on the substrate surface. The ceramic heater 110 is a low thermal capacity heater which increases in temperature with an abrupt rising property by energization to the heat generating resistor. The ceramic heater 110 is engaged is an engaging groove 103*a* provided along the lower surface of the press-contact member 103 with respect to the longitudinal direction.

The pressing roller 106 is prepared by molding and coating a heat-resistant elastic layer of a silicone rubber, a fluorine-containing rubber, a fluorine-containing resin or the like coaxially and integrally around a cylindrical metal core of stainless steel and by providing a parting layer as a surface layer. As a material for the parting layer, a material with a high parting property and high heat-resistant property such as fluorine-containing resin, silicone resin, fluorosilicone rubber, fluorine-containing rubber, silicone rubber, PFA, PTFE, FEP, or the like is selected. As shown in FIG. 3, at each of both end portions of the metal core of the pressing roller 106, an unshown bearing member of a heat-resistant resin material such as PEEK, PPS or a liquid crystal polymer or the like is mounted, and the pressing roller 106 is provided by being rotatably held by a side plate of a fixing frame 114. At each of longitudinal ends of the stay 102, a fixing flange 104 is attached non-rotatably. The fixing flange 104 is non-rotatably engaged with and held by the side plate of the fixing frame 114. The fixing flange 104 rotatably supports the end portion of the cylindrical fixing belt 101.

As shown in FIG. 2, the fixing flange 104 is engaged with each of both ends of an assembly of the press-contact member 103 and the stay 102, so that rotation of the fixing belt 101 with respect to a circumferential direction is guided and disconnection of the fixing belt 101 in the longitudinal direction is prevented.

A temperature detecting portion 105 detects the temperature of the fixing belt 105 at the inner surface and feeds back the detected temperature data to a controller 120 of the ceramic heater 110. The temperature detecting portion 105 includes a temperature detecting element 105*b* and is urged outward by a leaf spring portion 105*c*, thus being contacted to the inner surface of the fixing belt 101 with a predetermined contact pressure.

<Exchanging Operation of Fixing Belt>

Parts (a) and (b) of FIG. 4 are illustrations of a first half portion of an exchanging (replacing) operation of the fixing belt. Parts (a) and (b) of FIG. 5 are illustrations of a latter half portion of the exchanging operation of the fixing belt. As shown in FIG. 2, the press-contact member 103 and the stay 102, which are an example of a supporting structure, extend inside the fixing belt 101 and are non-rotatably disposed to support the inner surface of the fixing belt 101.

The pressing roller 106, which is an example of a rotatable pressing member, contacts an outer surface of the fixing belt 101 at the heating nip N for pressing the recording material P between itself and the fixing belt 101.

The ceramic heater 110 which is an example of a heating means heats the fixing belt 101 for heating the heating nip N. The fixing belt unit 113 is capable of replacing the fixing belt 101 with a new one by moving the fixing belt 101 along the press-contact member 103 and the stay 102.

Incidentally, the belt heating type of image heating apparatus is accompanied by the problem of the durability of the fixing belt 101 compared with the heating roller type of image heating apparatus. For that reason, a fixing device 40 capable of replacing only the fixing belt 101 is provided. In the case of the fixing device 40, only the fixing belt 101, which is the rotatable member with the shortest lifetime of rotatable members in the image forming apparatus 1, is replaced and therefore, parts that still have not reached the end of their lifetimes were able to be continuously used as they were. As a result, it was possible to considerably decrease the maintenance cost of the image forming apparatus 1 and it also becomes possible to really efficiently use the image forming apparatus 1 also in a sense of resource saving.

As shown in FIG. 1, the fixing device 40 is pulled out toward the front side as a whole and is demounted from the image forming apparatus 1 and then is mounted on a working table as shown in (a) of FIG. 4.

As shown in (a) of FIG. 4, first, both ends of each of the fixing belt unit 113 and the pressing roller 106 are assembled with the side plates of the fixing frame 114.

As shown in (b) of FIG. 4, next, a fixing screw is disconnected at each of the both ends of the fixing belt unit 113, and then the fixing belt unit 113 is raised in an arrow A direction, thus being demounted from the fixing frame 114.

As shown in (a) of FIG. 5, next, the fixing flange 104 at one side is slid in an arrow B direction, thus being demounted from the fixing belt unit 113.

As shown in (b) of FIG. 5, next, the fixing belt 101 is pulled out toward the demounted fixing flange 104 side, i.e., in an arrow C direction. The pulled-out fixing belt 101 reaches the end of its lifetime and therefore is discarded. Then, in a state in which the fixing belt 101 is pulled out, a heat-resistant grease remaining at the lower surface of the press-contact member 103 is cleaned (removed) with alcohol. Thereafter, onto the press-contact member 103 (ceramic heater 110), a new heat-resistant grease is applied. Then, a new fixing belt 101 is inserted in an arrow D direction from a side where the fixing belt 101 is pulled out earlier.

As shown in (a) of FIG. 5, in a state in which the new fixing belt 101 is inserted and its (leading) end portion is held by the fixing flange 104, the fixing flange 104 demounted earlier is inserted into an arrow E direction to be mounted to the fixing belt 101 again.

As shown in (b) of FIG. 4, finally, when the thus assembled fixing belt unit 113 is engaged with the fixing frame 114, the replacement (exchange) of the fixing belt 101 is completed. The fixing device 40 is returned into the image forming apparatus 1 shown in FIG. 1.

Comparative Embodiment

FIG. 6 is an illustration of a structure of a fixing device in Comparative Embodiment. As shown in FIG. 2, the temperature detecting portion 105 is urged outward by the leaf spring portion 105*c* and therefore when the fixing belt 101 is pulled out, the temperature detecting portion 105 projects toward the outside. For this reason, when the new fixing belt 101 is inserted, an edge of the fixing belt 101 interferes with the temperature detecting portion 105. In the fixing device 40, as shown in (b) of FIG. 5, during the insertion of the fixing belt 101 into the arrow D direction, the end surface of the fixing belt 101 interferes with the temperature detecting portion 105 for detecting the inner surface temperature of the fixing belt 101.

When the fixing belt 101 is forcedly pushed inward in a state in which the end surface of the fixing belt 101 is abutted against the end portion of the temperature detecting portion 105, creases can be provided at an edge of the fixing belt 101. In the state of interference of the edge of the fixing belt 101, when the temperature detecting portion 105 is pressed toward the inside with a finger to be placed at the inside of the fixing belt 101, the fixing belt 101 can be obliquely inserted, thus running against the stay. For this reason, there arose a problem such that the fixing belt unit 113 was not readily assembled considerably.

During the insertion of the fixing belt 101, the fixing belt 101 damaged the temperature detecting portion 105, so that accurate temperature detection was unable to be performed in some cases. During the insertion of the fixing belt 101, the leaf spring portion 105*c* of the temperature detecting portion 105 was torsionally deformed to slant the temperature detecting portion 105, so that the contact of the temperature detecting portion 105 with the inner surface of the fixing belt 101 became unstable in some cases. For these reasons, before and after the exchange of the fixing belt 101, the temperature or temperature distortion in the heating nip N was changed, so that the glossiness of the image varied in same cases.

Therefore, in the following embodiments, an inclined surface is provided to the temperature detecting portion 105 with respect to an insertion direction of the fixing belt 101, so that the interference of the temperature detecting portion 105 with the fixing belt 101 is alleviated. As a result, while ensuring reliability of the temperature detection by the temperature detecting portion 105 for detecting the inner surface temperature of the fixing belt 101 in stand-alone exchange of the fixing belt 101, an exchange property of the fixing belt 101 is improved.

Embodiment 1

Parts (a) and (b) of FIG. 7 are illustrations of a structure of the temperature detecting portion in the fixing device in Embodiment 1. Parts (a) and (b) of FIG. 8 are illustrations of balance of forces exerted on the temperature detecting portion. Parts (a) and (b) of FIG. 9 are illustrations of the interference between the edge of the fixing belt and the temperature detecting portion.

As shown in FIG. 2, the temperature detecting portion 105 is contacted to the inner surface of the fixing belt 101 at the downstream side of the heating nip N with respect to the rotational direction of the fixing belt 101 by being elastically deformed by the stay 102 which is an example of a supporting portion.

As shown in (a) of FIG. 7, an insertion guide 109 which is an example of the inclined surface is provided to the temperature detecting portion 105 and guides the temperature detecting portion 105 toward the inside of the fixing belt 101 against the elastic support by the contact with the fixing belt 101 during the mounting operation of the fixing belt 101.

The temperature detecting portion 105 is, in order to enhance followability thereof with respect to the inner surface of the fixing belt 101 by weight reduction, molded of a foam resin material into an integral whole member including the insertion guide 109 in a state in which the temperature detecting element 105*b* is buried at the front surface side.

The temperature detecting portion 105 is elastically supported by the stay 102 so as to urge the inner surface of the fixing belt 101 toward the outside of the fixing belt 101 along the rotational direction of the fixing belt 101 directed toward the upstream side by using the two parallel leaf spring members which also function as signal lines of the temperature detecting element 105*b*.

At a sensor leading portion 105*e*, an engaging hole 105*f* for being engaged with an unshown engaging shaft of the press-contact member 103. The temperature detecting portion 105 detects the temperature by the contact of the temperature detecting element 105*b* with the inner surface of the fixing belt (101: FIG. 2). A heat insulating sponge 105*g* is formed of a sponge material having a cushioning property for causing a detection surface of the temperature detecting element to follow the fixing belt 101.

As shown in (b) of FIG. 7, an insulating tape 115 is formed of a low-frictional insulating tape material wound to cover an outer surface of the heat insulating sponge 105*g* of the temperature detecting portion 105 in which the temperature detecting element 105*b* is embedded. The temperature detecting portion 105 is mounted to the press-contact member 103 at a holding portion (fixing portion) 105*e*, thus being positioned and held.

The leaf spring portion 105*c* has elasticity for urging the temperature detecting portion 105 toward the inner surface of the fixing belt 101. The leaf spring portion 105*c* is formed of the stainless steel to constitute also an electroconductive path of the temperature detecting element 105*b*. The leaf spring portion 105*c* has a spring property with respect to a direction in which the temperature detecting portion 105 is contacted to the inner surface of the fixing belt 101, so that the temperature detecting portion 105 is contacted to the inner surface of the fixing belt 101 with reliability.

As shown in (a) of FIG. 7, the temperature detecting portion 105 is provided with the insertion guide (inclined surface) 109 at each of left and right sides thereof. The insertion guide 109 is prepared by being obliquely cut to form the inclined surface and is covered with the insulating tape 115, thus lowering a frictional resistance during the insertion. Here, an inclination angle (actuate angle) is set within a range from 30 degrees to 75 degrees.

As shown (a) of FIG. 8, the end portion of the fixing belt 101 interferes with the inclined surface of the insertion guide 109. In this embodiment, when there is no fixing belt 101, the leaf spring portion is set so that the temperature detecting portion 105 is disposed outside an extension line L of a fixing belt 101 supporting surface of the fixing flange 104 by the leaf spring portion 105*c*. The reason therefor is that the contact property between the temperature detecting portion 105 and the fixing belt 101 is enhanced. In Embodiment 1, the temperature detecting portion 105 is disposed on the extension line L. As shown in (b) of FIG. 8, the insertion guide 109 is tapered from the inside toward an end of the temperature detecting portion 105 by Δt1, where the temperature detecting element 105*b* is disposed, thus having a role as the insertion guide of the fixing belt 101. At this time, the end of the temperature detecting portion 105 is located outside the inner surface of the fixing belt 101 by Δt2.

F: force received, from fixing belt, by fixing belt insertion guide

F1: vertical component force of force F with respect to fixing belt insertion direction F2: component force of force F with respect to fixing belt insertion direction Δt1: positional difference between insertion guide end and fixing belt inner surface Δt2: positional difference between temperature detecting portion end and fixing belt inner surface As shown in (b) of FIG. 5, when the fixing belt 101 is inserted in an arrow D direction, as shown in (b) of FIG. 8, the temperature detecting element 105*b* which is the end of the temperature detecting portion 105 is located outside the inner surface of the fixing belt 101 by Δt2.

However, in this embodiment, the temperature detecting portion 105 is provided with the insertion guide 109 and therefore when the fixing belt 101 is inserted in the arrow D direction, the insertion guide 109 is abutted against the fixing belt 101 to receive the force F. Then, the component force F1, directed toward the inside, of the force F pushes the entire temperature detecting portion 105 toward the inside of the inner surface of the fixing belt 101. By the action of this force F1, it becomes possible to easily insert the fixing belt 101 without giving special consideration to the temperature detecting portion 105 as in Comparative Embodiment described with reference to FIG. 6.

After the end of the exchange of the fixing belt 101, the temperature detecting element 105*b* of the temperature detecting portion 105 is contacted to the inner surface of the fixing belt 101 with the original attitude and pressure by the elasticity of the leaf spring portion 105*c*.

As shown in (a) and (b) of FIG. 9, the temperature detecting portion 105 is provided with the insertion guide (inclined surface) 109 at each of its left and right sides so that the fixing belt 101 may be inserted from either of the left and right directions. The insertion guide 109 may be formed of a plate material bent in a bow-like shape or may be covered with the insulating tape 115 at the surface of the plate material. By applying the present invention to such an insertion guide 109, a similar effect can be obtained.

Embodiment 2

FIG. 10 is an illustration of a structure of a fixing device in Embodiment 2. FIG. 11 is an illustration of a fixing flange mounted structure. Parts (a) and (b) of FIG. 12 are illustrations of a structure of a temperature detecting portion in the fixing device in this embodiment. FIG. 13 is an illustration of an interference between an edge of a fixing belt and the temperature detecting portion.

As shown in FIG. 10, the fixing flange 104*a*, which is an example of a fixing-side flange member, is fixed to one end portion of the stay 102 and thus slides with the inner surface of the fixing belt 101 at one end portion of the fixing belt 101. The fixing flange 104*b*, which is an example of a mounting-and-demounting-side flange member, is detachably fixed to the other end portion of the stay 102 and thus slides with the inner surface of the fixing belt 101 at the other end portion of the fixing belt 101. The insertion guide 109 is provided at a side where the fixing flange 104*b* is disposed with respect to the longitudinal direction of the stay 102 but is not provided at a side where the fixing flange 104*a* is disposed.

At both ends of the fixing belt unit 113 with respect to the longitudinal direction, the fixing flanges 104*a* and 104*b* are mounted. The fixing flange 104*a* at a side where a harness 117 for connecting the heater and the sensor to an external temperature-control circuit is mounted is fixed to the fixing belt unit 113 with a screw 108. Therefore, a direction in which the fixing belt 103 can be inserted in and pulled out is limited to the (movable) direction of the other (opposite)-side fixing flange 104*b*. However, an engaging method of the fixing flange 104*a* and the stay 102 is not limited to the screw 108 if it is a method which takes much time to demount and mount the fixing flange 104*a*.

As shown in FIG. 11, to the one-side fixing flange 104*a*, the stay 102 and the press-contact member 103 which extends the inside of the fixing belt 101 are connected by the screw 108. For this reason, the fixing flange 104*a* can only be demounted by using a tool. By this constitution, during the exchange of the fixing belt 101, the insertion direction of the fixing belt 101 is regulated. That is, only in the direction opposite from the fixing flange 104*a*, the insertion and extraction of the fixing belt 101 can be effected.

As shown in (a) of FIG. 12, the temperature detecting element 105*b* of the temperature detecting portion 105 is provided with the insertion guide 109 (inclined surface). The insertion guide 109 is disposed only at a side opposite from the side where the fixing flange 104*a* is fixed to the stay 102 with the screw 108.

The entire temperature detecting portion 105 including the insertion guide 109 is, similarly as in Embodiment 1, formed with the heat insulating sponge 105*g* defining its outer appearance and is surface-covered with the insulating tape 115. However, the insertion guide 109 may also be formed by bending a metal plate or a resin plate and may also be formed by being cut out from a thick insulating material, so that a similar effect can be obtained by applying the present invention to the above insertion guide 109.

The exchanging procedure of the fixing belt unit 113 is as described above with reference to FIGS. 4 and 5 but this embodiment is different from Embodiment 1 in that the fixing flange 104*b* is extracted and then the fixing belt 101 is extracted from and inserted into the fixing flange 104*b* side.

As shown in FIG. 13, when the fixing belt 101, which reaches the end of its lifetime, is pulled out, the temperature detecting portion 105 is projected, by spring urging, toward the outside of the position in which the fixing belt 101 was located. However, even in this state, the length of the inclined surface of the insertion guide 109 (the size of the temperature detecting portion 105) is designed so that a part of the insertion guide 109 is located inside the position in which the fixing belt 101 was located.

For this reason, when the fixing belt 101 is inserted in the arrow D direction, the end portion of the fixing belt 101 interferes with the insertion guide 109 and thus is smoothly guided along the inclined surface of the insertion guide 109. As shown in (b) of FIG. 8, the insertion guide 109 is abutted against the fixing belt 101 to receive the force F. Then, the component force F1, directed toward the inside, of the force F pushes the entire temperature detecting portion 105 toward the inside of the inner surface of the fixing belt 101. By the action of this force F1, it becomes possible to easily insert the fixing belt 101 without giving special consideration to the temperature detecting portion 105 as in Comparative Embodiment described with reference to FIG. 6.

Then, after the end of the exchange of the fixing belt 101, the temperature detecting element 105*b* of the temperature detecting portion 105 is contacted to the inner surface of the fixing belt 101 in the original state by the leaf spring portion 105*c*.

As described above, in the image heating apparatus of the present invention, the inclined surface formed at the temperature detecting portion slides with the edge of the heating belt member to be inserted, thus placing (moving) the temperature detecting portion toward the inside of the heating belt member, so that an undue force is not exerted on the structure, which elastically supports the temperature detecting portion, with respect to the insertion direction.

Therefore, even when the new product exchange of the heating belt member is repeated, the contact state between the temperature detecting portion and the inner surface of the heating belt member is reproduced at a constant level, so that the fixed image is prevented from causing variation and non-uniformity of its glossiness.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 022123/2011 filed Feb. 3, 2011, which is hereby incorporated by reference.

What is claimed is:

1. An image heating apparatus comprising:

a demountable endless belt configured to heat a toner image on a recording material at a nip portion;

a rotatable member configured to form the nip portion cooperatively with said endless belt;

a supporting member, provided in said endless belt and configured to support said endless belt;

a heating device configured to heat said endless belt;

a temperature detecting member including (i) a temperature detecting element provided so as to contact an inner surface of said endless belt and configured to detect the temperature of said endless belt, and (ii) an elastic portion provided on said supporting member configured to (a) urge said temperature detecting element toward the inner surface of said endless belt and (b) permit a displacement of said temperature detecting element toward said supporting member by an elastic deformation thereof;

a controller configured to control energization of said heating device based on an output of said temperature detecting member; and an inclined surface, provided to said temperature detecting member and configured to abut to an end edge of said endless belt in a longitudinal direction of said endless belt so that said temperature detecting element is displaced by the elastic deformation with a mounting operation of said endless belt relative to said supporting member in a direction substantially parallel to the longitudinal direction, wherein an inclined angle of said inclined surface is from 30 degrees to 75 degrees with respect to the longitudinal direction.

2. An image heating apparatus according to claim 1, wherein said elastic portion includes a leaf spring portion.

3. An image heating apparatus according to claim 1, wherein said inclined surface is made of a foam resin material.

4. An image heating apparatus according to claim 1, wherein said temperature detecting member includes an electrically insulating portion configured to perform slide contact with the inner surface of said endless belt.

5. An image heating apparatus according to claim 1, wherein said supporting member includes a pressing member configured to press said endless belt toward said drive rotatable member.

6. An image heating apparatus comprising:

a demountable endless belt configured to heat a toner image on a recording material at a nip portion;

a drive rotatable member configured to (a) drive said endless belt to rotate and (b) form the nip portion cooperatively with said endless belt;

a supporting member provided in said endless belt and configured to support said endless belt;

a heating device configured to heat said endless belt;

a temperature detecting member including (i) a temperature detecting element provided so as to contact an inner surface of said endless belt and configured to detect the temperature of said endless belt, and (ii) an elastic portion provided on said supporting member and configured to (a) urge said temperature detecting element toward the inner surface of said endless belt and (b) permit a displacement of said temperature detecting element toward said supporting member by an elastic deformation thereof;

a controller configured to control energization of said heating device based on an output of said temperature detecting member; and an inclined surface provided on said temperature detecting member and configured to abut to an end edge of said endless belt in a longitudinal direction of said endless belt so that said temperature detecting element is displaced by the elastic deformation with a mounting operation of said endless belt relative to said supporting member in a direction substantially parallel to the longitudinal direction, wherein an included angle of said inclined surface is from 30 degrees to 75 degrees with respect to the longitudinal direction.

7. An image heating apparatus according to claim 6, wherein said elastic portion includes a leaf spring portion.

8. An image heating apparatus according to claim 6, wherein said inclined surface is made of a foam resin material.

9. An image heating apparatus according to claim 6, wherein said temperature detecting member includes an electrically insulating portion configured to perform slide contact with the inner surface of said endless belt.

10. An image heating apparatus according to claim 6, wherein said supporting member includes a pressing member configured to press said endless belt toward said drive rotatable member.

* * * * *